US005178432A

United States Patent [19]

Zeman et al.

[11] Patent Number: 5,178,432

[45] Date of Patent: Jan. 12, 1993

[54] EMERGENCY RESCUE VEHICLE

[76] Inventors: Dennis Zeman, 144 N. Jefferson, Bonduel, Wis. 54107; Kurt Person, 25127 Westmoreland, Farmington Hills, Mich. 48336

[21] Appl. No.: 743,741

[22] Filed: Aug. 12, 1991

Related U.S. Application Data

[63] Continuation-in-part of Ser. No. 595,401, Oct. 11, 1990, abandoned.

[51] Int. Cl.[5] ..... A61G 3/00

[52] U.S. Cl. ..... 296/19; 296/25; 296/203; 296/204; 296/205; 296/183; 280/790

[58] Field of Search ..... 296/19, 25, 20, 183, 296/203-205; 280/790

[56] References Cited

U.S. PATENT DOCUMENTS

| | | | |
|---|---|---|---|
| 2,794,650 | 6/1957 | Schilberg | 296/204 X |
| 2,940,768 | 6/1960 | Thompson et al. | 296/25 |
| 3,204,998 | 9/1965 | Stollenwerk | 296/19 |
| 3,873,120 | 3/1975 | Lecomte et al. | 280/790 X |

*Primary Examiner*—Dennis H. Pedder
*Attorney, Agent, or Firm*—Dowell & Dowell

[57] ABSTRACT

An emergency rescue vehicle which includes a patient compartment which is accessible for patient loading through doors located along both sides and rear of the vehicle and wherein the primary patient support stretcher is pivotally carried centrally of the compartment and is extendable outwardly through any one of the access doors. The patient compartment is separated between tandem front wheel assemblies and a rear wheel assembly to obtain a continuously level and low loading height and the primary patient support is positioned generally at the center of mass of the vehicle.

10 Claims, 6 Drawing Sheets

EMERGENCY RESCUE VEHICLE

CROSS-REFERENCES TO RELATED APPLICATIONS

This application is a Continuation-in-Part application of Ser. No. 07/595,401 filed Oct. 11, 1990 entitled EMERGENCY RESCUE VEHICLE by Dennis Zeman and Kurt Person, now abandoned.

BACKGROUND OF THE INVENTION

1. Field of the Invention

This invention is generally directed to rescue type vehicles including ambulances and the like which include a patient compartment in which is mounted at least one bed or stretcher which may be extended from the interior of the compartment to the exterior of the vehicle through access doors located both along the sides and rear of a vehicle.

2. History of the Related Art

Emergency vehicles such as ambulances and rescue units provide a necessary first line of medical support and treatment which often makes the difference between life and death. Such vehicles are equipped with the necessary life support equipment to enable rescue crews to provide on site emergency medical attention to accident victims and other patients.

Conventionally, ambulances and rescue vehicles include one or more cots or stretchers on which patients are supported during transport from the site of an emergency to a hospital. In older vehicles, the stretchers were simple hand carried cots or litters which were supported on brackets mounted within the vehicle. An example of such a patient support is shown in U.S. Pat. No. 1,099,020 to Campbell. In an effort to increase the ease of patient handling and to further facilitate the supporting of conventional type cots in an emergency vehicle, special loading ramps and mounting brackets have been designed for supporting the cots in such vehicles. In U.S. Pat. 3,204,998 to Stollenwerk an ambulance is disclosed which has cot supports which are extendable laterally through the side walls of the vehicle. The structures include cot supports which are mounted to rails which telescope horizontally outwardly with respect to the bed of the vehicle thereby allowing cots to be placed on the supports from the exterior of the vehicle with the cots thereafter being rolled into the interior of the vehicle being guided by the rails. Unfortunately, with this type of arrangement, it is necessary to include a rail structure along the floor of the vehicle which interferes with the movement of technicians and emergency personnel within the vehicle. In addition, it is necessary with such a structure to physically lift a patient to a vertical position where a cot may be supported by the extendable supports.

Recognizing that technicians and emergency personnel are often injured by lifting patients in and out of emergency vehicles, a number of patient supports or stretchers have been provided for emergency vehicles which allow the stretchers to be loaded from a ramp which extends from within the vehicles. Such systems conventionally include cot supports having a main frame which is telescoped rearwardly of the vehicle and which is accessed by auxiliary ramps incorporated with the cot supports. Some examples of this type of patient supports are disclosed in West German patent 2,244,739 of Apr. 26, 1973; U.S. Pat. No. 4,378,128 to Holling et al.; and French patent 1,558,138 of Jan. 13, 1969.

Further improvements to patient supports for emergency vehicles have been directed to stabilizing cots or stretchers within emergency vehicles so that road shocks and vibrations are reduced as much as possible to thereby increase patient comfort. In many of these devices, special hydraulic supports and other devices are utilized to cushion a stretcher or cot to reduce vibrations to the patient being supported. Some examples of such vehicle beds or stretchers are disclosed in U.S. Pat. No. 3,752,526 to Vanderburgt et al. and West German patent 3,611,106 of Oct. 8, 1987.

Some additional examples of emergency vehicles and stretchers for emergency vehicles are disclosed in German patent 1,233,980 of Feb. 9, 1967; U.S. Pat. No. 3,630,565 to Lehmann; German patent 1,491,267 of Oct. 2, 1969; West German patent 2,244,739 of Apr. 26, 1973; Russian patent 1,250,499 of Aug. 1986; and U.S. Pat. Nos. 1,200,583 to Busha and 4,210,355 to Legueu.

SUMMARY OF THE INVENTION

This invention is directed to an emergency vehicle which includes a patient treatment compartment that is accessible through doors provided on either side and rear of the vehicle and wherein the primary patient stretcher is supported by a pivotally mounted and extendable base or platform. The vehicle includes a suspension system to prevent diving, pitching, or bouncing of the patient compartment through the use of a pair of forward steerable axles and a single rear axle each having incorporated therewith independently controlled TAG air bags. The base of the patient support platform is mounted within the vehicle so as to be generally centrally of the side doors of the vehicle at a point generally intermediate the center point of the front two axles and the rear axle so as to place the patient support at as close to the center of gravity of the vehicle as is possible. The vehicle chassis is designed to orient the floor of the patient compartment of the vehicle at a continuous level and minimum height above the vehicle axles to obtain a low center of gravity to further reduce shock and vehicle motion thereby increasing patient safety and comfort during transportation. The chassis is formed as a unitized structure with a specially designed roll cage for additional safety. In the preferred embodiment, the stretcher base or platform will include telescoping components or ramp components that will extend outwardly of the vehicle so that a conventional wheeled stretcher may be rolled from the ground directly onto the base.

It is a primary object of the present invention to increase emergency vehicle response time and loading accessibility to accident victims and other emergency care patients by allowing patients to be loaded from either side and rear of the emergency vehicle.

It is another object of the present invention to increase emergency vehicle operator safety by allowing attendants to ingress or egress the patient compartment of the vehicle from either side or rear of the vehicle and to create lower entry levels than heretofore accomplished with conventional rescue equipment to thereby reduce the physical effort required to load or discharge patients from the vehicle.

It is another object of the present invention to provide an emergency vehicle of the ambulance or rescue type which maximizes patient comfort and safety by placing the primary stretcher support platform at a point just above the height of the vehicle wheel axles and generally centrally of the center of gravity of the vehicle and to provide independently controlled air bag suspension to thereby reduce road shock, vibration and rocking motion to an absolute minimum.

It is a further object of the present invention to provide an emergency vehicle which includes a primary patient support platform which is not only extendable from the vehicle and which permits patient loading directly from the ground but also which does not interfere with emergency technicians, movements within the vehicle.

DESCRIPTION OF THE PREFERRED EMBODIMENT

Figure 1:
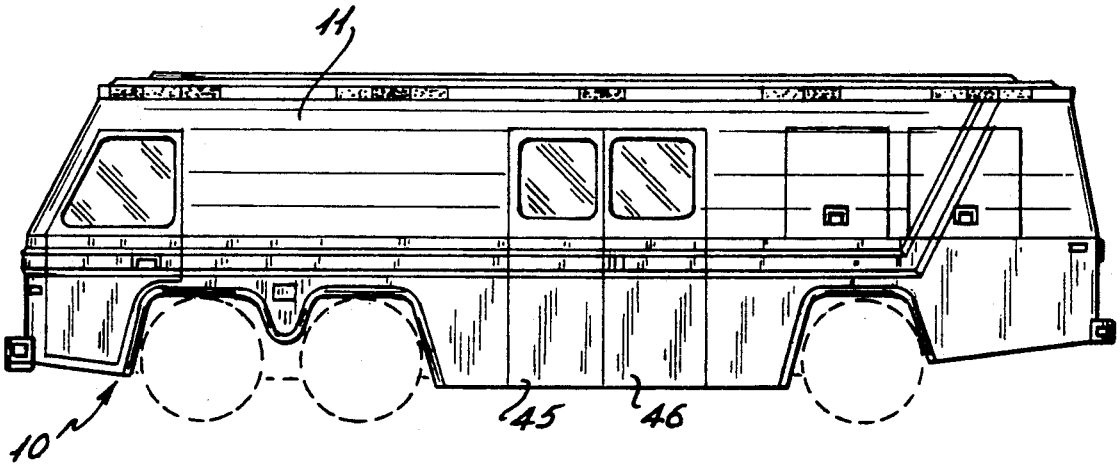
FIG. 1 is a left side elevational view of the emergency vehicle of the present invention.

With continued reference to the drawings, the emergency vehicle 10 of the present invention is shown as being in the form of an ambulance having an elongated body 11 which is unitized construction with a tubular roll cage 13 as will be discussed in greater detail hereinafter. The chassis includes a front frame section 14 and a continuous rear frame 15. The suspended frame portion 15 is shown as providing the support for the floor 16 of a patient compartment 17.

The front frame 14 of the chassis is supported by two pairs of wheel assemblies 18 and 19. Each of the wheel assemblies 18 and 19 includes an axle 20 and 21, respectively, which are mounted to the frame by shock absorbing TAG air bag assemblies 22 and 23. Unlike conventional emergency type vehicles, the vehicle of the present invention is designed to have tandem front end steering and therefore does include steerable axles 20 and 21. The specifics of the steering mechanism are not shown. The purpose for incorporating tandem front end steering is to allow shocks to be absorbed by each of the separate axles so that as the front axle 20 reacts to a road obstruction or bump wheel assembly 19 will carry the weight of the vehicle stabilizing the front end and thereby further absorbing shocks which would otherwise be imparted to the frame and to a patient being transported by the vehicle. In a like manner, when the axle 21 reacts to a bump or road shock, wheel assembly 18 will stabilize the vehicle.

The rear frame 15 is supported by a wheel assembly 25 which incorporates a rear axle 26 mounted to the rear by shock absorbing TAG air bag assembly 27. Each of the air bag assemblies 22, 23, and 27 are independently controlled and pneumatically pressurized by an on-board computer monitoring system to thereby compensate for road vibrations and to prevent diving or rocking of the vehicle frame.

Figure 3:
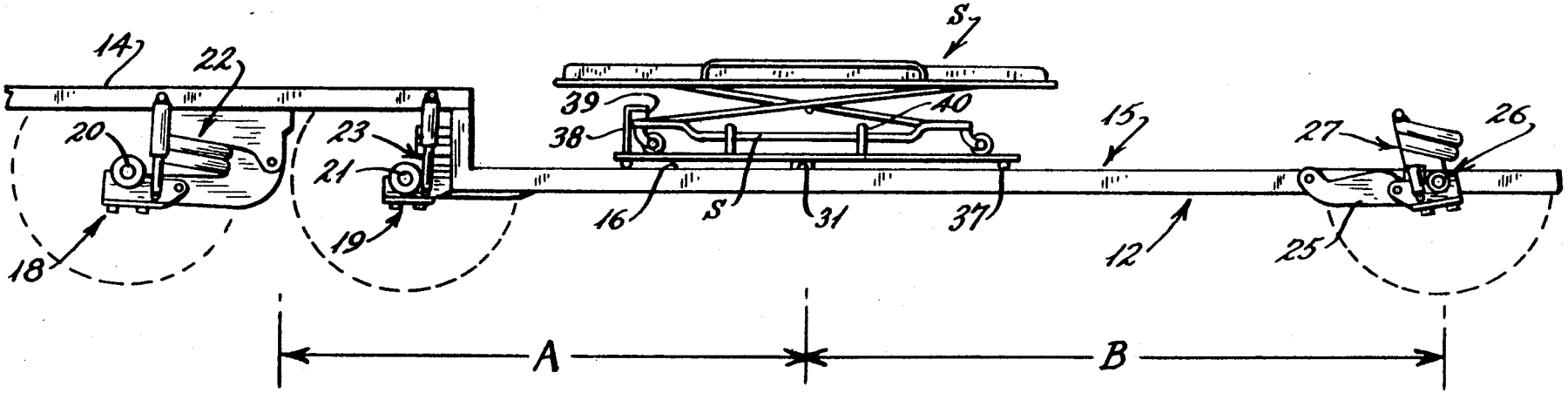
FIG. 3 is a partial cross-sectional illustration showing a portion of the frame and the patient support within the patient compartment of the vehicle of the present invention showing its relationship with respect to the vehicle axles.

The design of the carriage or chassis of the emergency vehicle of the present invention is such as to reduce vibrations and shocks to the floor 16 of the patient compartment to a minimum. As previously discussed, the tandem front wheels absorbs shocks by effectively allowing one of the two front axles 20 or 21 to steady the vehicle while the other wheel assembly encounters a bump, hole or other object. Further, it should be noted that the suspended patient support portion 16 of the frame is designed to be as close to the center of gravity of the vehicle as possible. In this respect, the central portion 16 of the suspended frame 15 is shown as being positioned intermediate the rear axle and a point spaced between the front tandem axles. The distances shown at (A) and (B) in FIG. 3 of the drawings should equal each other as closely as possible. In addition, it should be noted that the level of floor 16 relative to the axles 20, 21 and 26 is such that the floor is suspended at a low point to provide a low center of gravity for the floor structure and also for any patient support which is mounted on the floor 16 of the patient compartment. In conventional ambulances, floor or loading heights may exceed 30 inches whereas, in the present invention, the suspended frame portion 15 is positioned between one to two inches above the axles thereby creating a loading or floor height of approximately 17–18 inches with the vehicle axles being at a height of approximately 9 inches from the ground. By providing a low center of gravity and by positioning patient supports at the mid point between the axles as previously discussed, not only will there be less vibration due to road shocks but the floor of the vehicle 16 will also be stabilized during turning motions of the vehicle.

Figure 4:
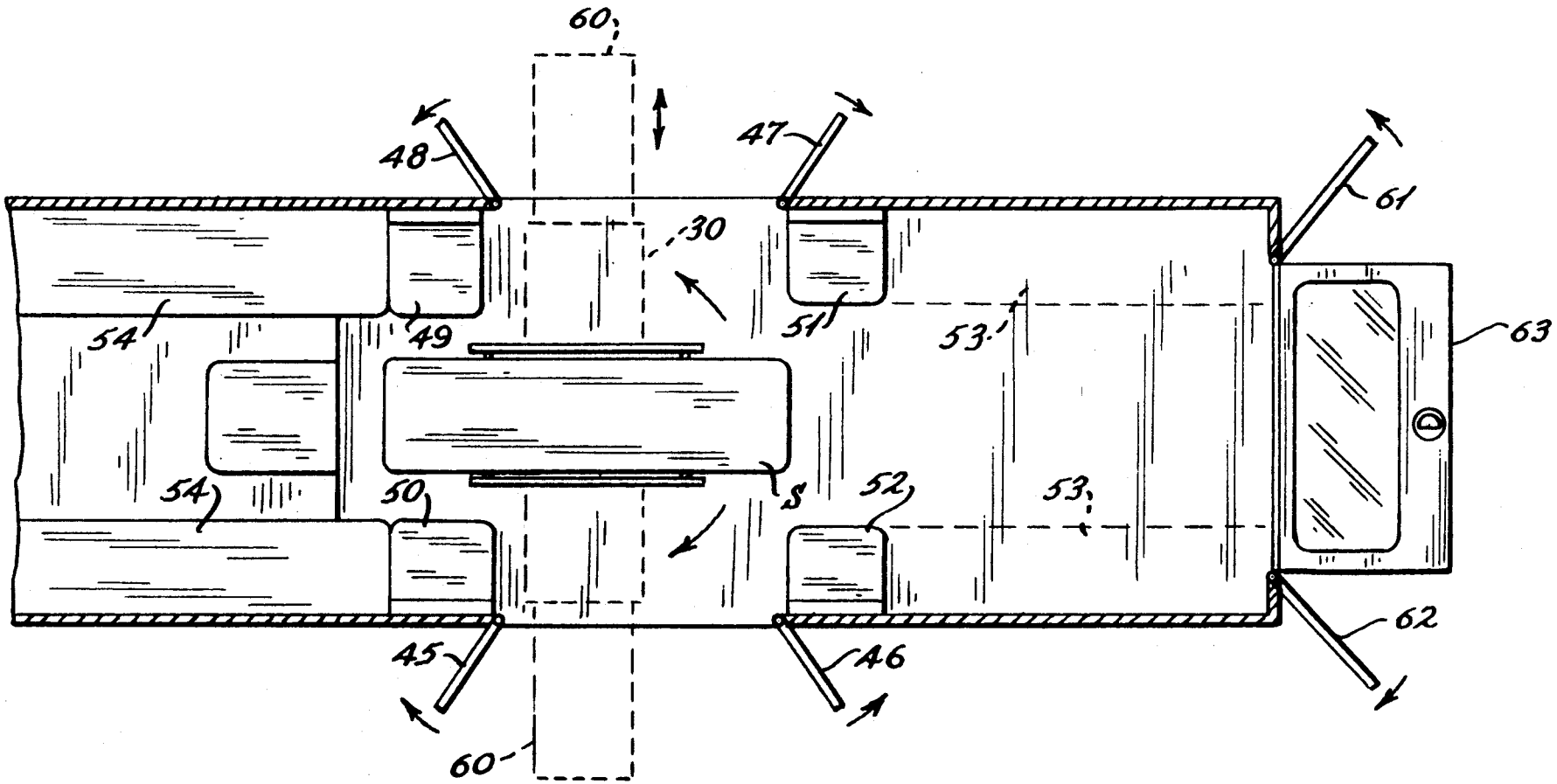
FIG. 4 is a top plan illustrational view of the patient compartment of the present invention showing the movement of the patient support stretcher in dotted line.

Although the types of patient supports provided within the patient compartment 17 of the vehicle may vary in type and number, in the preferred embodiment of the invention at least one primary patient support base 30 is shown which is pivotally mounted to the floor 16 of the patient compartment by bearing assembly 31 which is centrally located within the compartment and the side doors thereof. The bearing assembly may be of any conventional design and permits the base 30 to be rotated a full 360° with respect to the floor 16. In FIG. 4 the base is shown as supporting a conventional collapsible stretcher (S) which has been wheeled onto the base in a manner which will be described in greater detail hereinafter.

Figure 2:
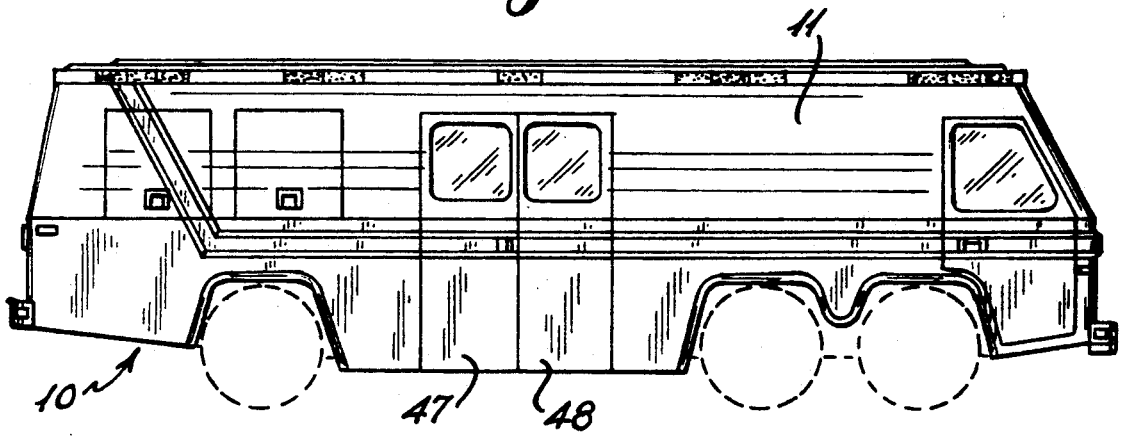
FIG. 2 is a right side elevational view of the emergency vehicle of the present invention.
Figure 7:
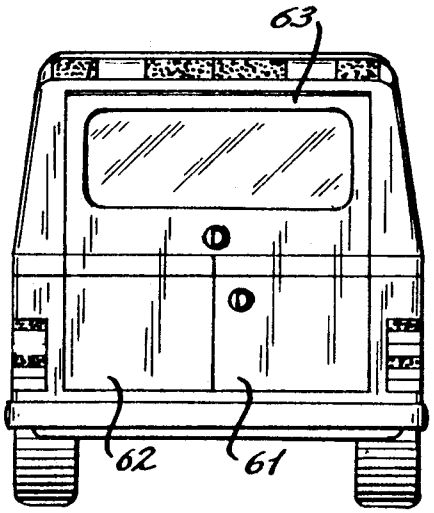
FIGS. 6 and 7 are left side and rear elevational views of the emergency vehicle of the present invention showing the door configuration thereof.
Figure 6:
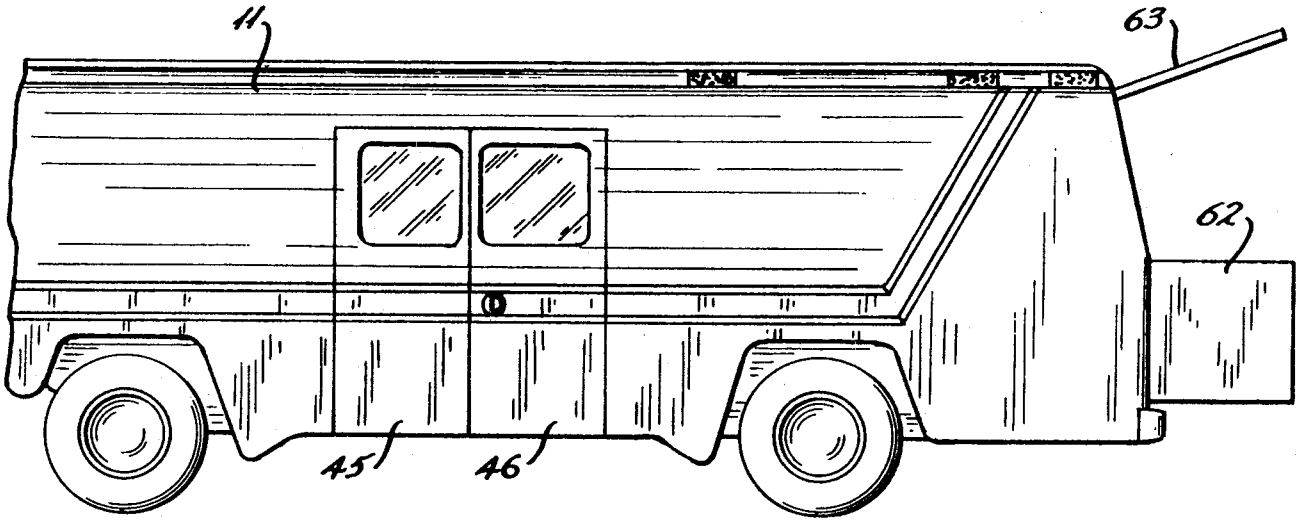

In an effort to provide increased response time to accident and emergency victims and also to protect the crew of the rescue vehicle, the present invention permits patients to be loaded from either side and rear of the vehicle. The vehicle therefore includes a pair of side doors 45 and 46 on the left side of the vehicle and another pair of doors 47 and 48 on the right side of the vehicle, as is shown in FIGS. 1 and 2. Rear doors 61, 62, and 63 provide rear access with door 63 providing quick top loading capabilities as shown in FIGS. 6 and 7.

With specific reference to FIG. 4, the top plan view of the patient compartment is disclosed in greater detail. It will be noted that the base 30 which is shown in dotted line for supporting the stretcher (S) may be rotated toward either side and rear of the vehicle so that patients may be loaded through access doors 45 and 46, 47 and 48 or rear access doors 61, 62, and 63, depending on the approach of the vehicle. As previously discussed, the base 30 having the stretcher (S) located thereon, is shown as being oriented along the center line of the vehicle and intermediate the side doors. Any suitable locking means may be provided for securing the base 30 relative to the vehicle floor when either rotated in line with the central axis of the vehicle or when moved as indicated by the arrows in the drawing figure so as to align the base for loading or unloading of the stretcher (S) from the sides. In order to permit rotation of the base, a pair of opposing technician lift seats 49 and 50, which are located on either side of the base 30, may be raised or lowered so as not to interfere with the rotation of the stretcher and base 30. Additional technician or patient seating is provided by seats 51 and 52 provided adjacent the rear portion of the vehicle. Storage areas 53 are also provided along the side and rear portions of the compartment 17 for storing medical equipment and supplies. Additional patient bedding or seating may be provided along the front portion of the patient compartment, as indicated at 54, for less critical patients.

To further assist rescue personnel in loading and unloading patients with respect to the emergency vehicle, the base portion 30 may include a separate or integrally formed ramp extension 60 as shown in dotted line in FIG. 4. The ramp is inclined vertically so that the stretcher (S) may be rolled down the ramp and to the ground in order to remove the stretcher from the vehicle without requiring that the crew lift the patient and stretcher. In other embodiments it may be possible to provide hydraulic extensions for the base 30.

Figure 5:
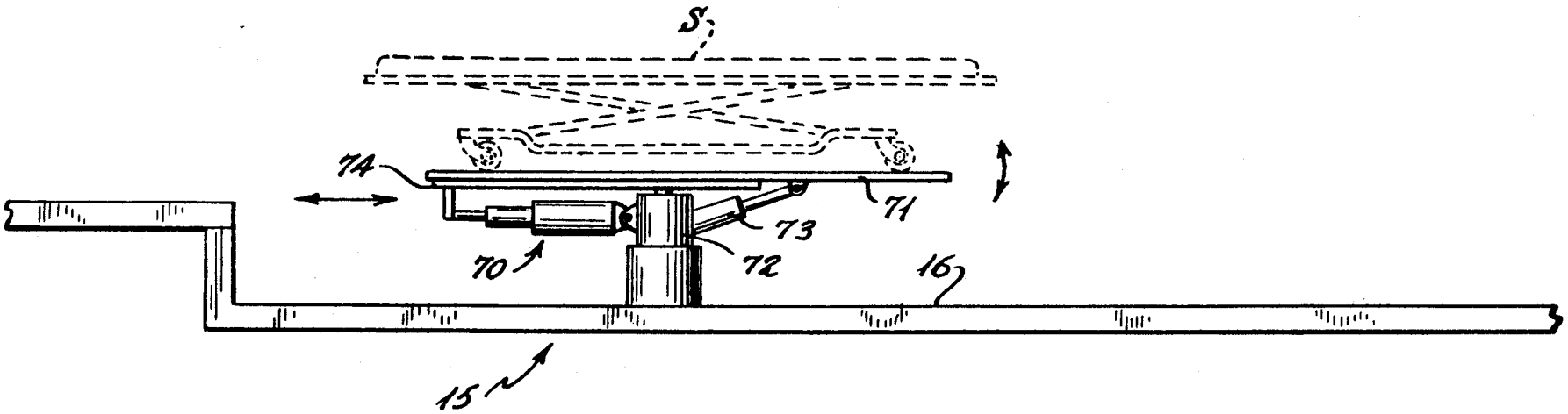
FIG. 5 is a side elevational view of one embodiment of stretcher support which may be utilized with the vehicle of the present invention.

With reference to FIG. 5, another embodiment of stretcher support base 70 is disclosed in greater detail. In this embodiment, the stretcher base includes a platform 71 which is secured in fixed relationship to the central portion of the vehicle in the same area as was described with respect to the first embodiment by a rotatable and vertically adjustable pedestal 72. The stretcher may be carried by the platform in a manner similar to that discussed with respect to base 30. Further, the platform may be raised or lowered by use of a pneumatic piston 73 which is provided beneath the support platform. The pedestal permits the raising and lowering of the platform and the piston allows the platform to be pivoted about the vertical so that a patient can be inclined from head to toe as may be necessary. The platform also includes extension 74 which is pneumatically operated and which will act as a ramp to allow stretchers to be loaded from the exterior of the vehicle through either the side or rear doors.

Figure 8:
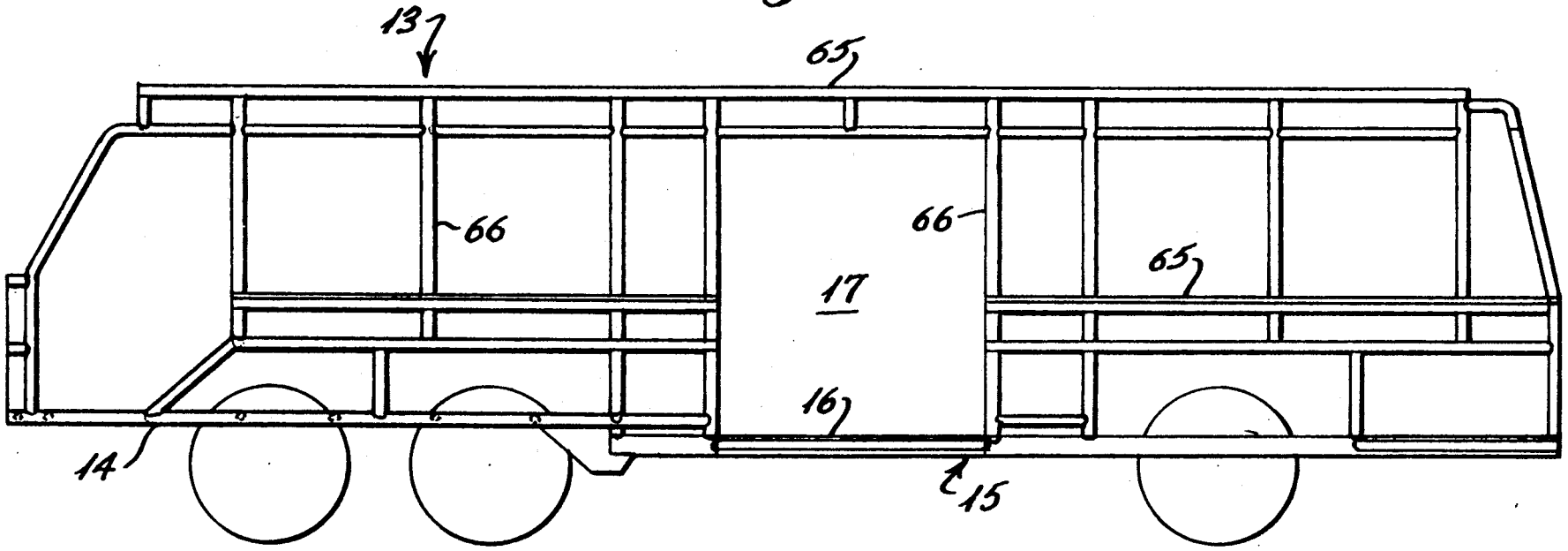
FIG. 8 is a left side elevational view of the emergency vehicle of the present invention showing the tubular roll cage structure and lower frame elevations.

With particular reference to FIG. 8, the tubular roll cage 13 of the present invention is shown in greater detail. The roll cage is provided for increased vehicle stability and for personal protection. The frame includes a plurality of horizontally and vertically oriented tubular members 65 and 66, respectively, which form the primary structure of the cage and which are directly welded to the frame components 14 and 15 so as to provide a unitized body construction. Due to the combined components of the vehicle, it is possible to obtain a mobile surgical environment which permits critical procedures to be performed on a patient while being transported. The drop frame 15 associated with the specific suspension system, tandem front wheel drive, together with the center of gravity positioning of the patient reduce road shocks and vehicle dive and pitch effects to an absolute minimum. Thus, it is possible to provide proper CPR and IV injection administration as well as other medical procedures during patient transport. In addition, the opposing side doors and rear access with low level flooring, facilitates not only patient loading and unloading but provides for the maximum safety of the crew in moving patients to and from the transport vehicle.

We claim:

1. An emergency rescue vehicle comprising, a chassis including a front frame section and a continuously rectilinear rear frame section, said rear frame section having means for being suspended vertically below said front frame section, at least one front axle mounted to said front frame section and a rear axle mounted to said rear frame section, a roll cage secured to said front and rear frame sections, a body supported by said chassis and said roll cage, said body having opposite side walls, an end wall and a floor portion, said floor portion being carried by said rear frame section which defines a patient compartment, an access door in each of said side walls on opposite sides of said patient compartment and in said rear wall, a stretcher support means mounted within said patient compartment spaced intermediate said access doors in said side walls, means for pivotally mounting said stretcher support means to said floor portion so as to be positioned generally midway between said front axle and rear axle whereby said stretcher support means may be rotated toward any of said access doors.

2. The emergency rescue vehicle of claim 1 in which said stretcher support means includes extension means which is extendable outwardly with respect to said access doors of said vehicle.

3. The emergency vehicle of claim 2 including adjustment means for inclining said stretcher support means vertically with respect to said floor.

4. The emergency vehicle of claim 2 in which said chassis includes tandem front axles, said means for pivotally mounting said stretcher support means being located at a first distance with respect to said rear axle and a second distance with respect to a point intermediate said tandem front axles, said second distance being substantially equal to said first distance.

5. The emergency vehicle of claim 4 in which said tandem front axles and said rear axle are oriented at a first vertical height, and said rear frame section is positioned at a second height which is slightly greater than said first height whereby said floor portion of said patient compartment will have a low center of gravity with respect to said vehicle.

6. The emergency vehicle of claim 5 in which said floor portion is at a loading height of approximately 18 inches or less from the ground.

7. The emergency vehicle of claim 1 in which said chassis includes tandem front axles, said means for pivotally mounting said stretcher support means being located at a first distance with respect to said rear axle and a second distance with respect to a point intermediate said tandem axles, said second distance being substantially equal to said first distance.

8. The emergency vehicle of claim 7 in which said tandem front axles and said rear axle are oriented at a first vertical height, and said rear frame section is positioned at a second height which is slightly greater than said first height whereby said floor portion of said patient compartment will have a low center of gravity with respect to said vehicle.

9. The emergency vehicle of claim 8 in which said floor portion is at a loading height of approximately 18 inches or less from the ground.

10. The emergency vehicle of claim 7 including separate air bag shock absorbing means associated with each of said front and rear axles.

* * * * *